United States Patent [19]

Coles

[11] 4,056,032

[45] Nov. 1, 1977

[54] MUSICAL APPARATUS

[76] Inventor: Donald K. Coles, 2505 Capital Ave., Fort Wayne, Ind. 46806

[21] Appl. No.: 679,814

[22] Filed: Apr. 23, 1976

[51] Int. Cl.[2] ..... G10H 1/00

[52] U.S. Cl. ..... 84/1.01; 84/445

[58] Field of Search ..... 84/445–449, 84/1.01, 1.03, 1.04, 1.07, 1.08, 1.28

[56] References Cited

U.S. PATENT DOCUMENTS

| | | | |
|---|---|---|---|
| 2,539,130 | 1/1951 | Grudin | 84/445 |
| 3,023,659 | 3/1962 | Bode | 84/445 |
| 3,401,229 | 9/1968 | Kawabata et al. | 84/1.04 |
| 3,674,907 | 7/1972 | Derry | 84/445 |
| 3,824,325 | 3/1975 | Obayashi et al. | 84/1.01 |
| 3,871,261 | 3/1975 | Wells et al. | 84/1.01 |
| 3,877,337 | 4/1975 | Obayashi et al. | 84/1.01 |
| 3,910,149 | 10/1975 | Obayashi | 84/1.01 |
| 3,933,072 | 1/1976 | van der Wal et al. | 84/1.01 |
| 3,949,638 | 4/1976 | Coles | 84/1.01 |
| 3,971,282 | 7/1976 | Obayashi et al. | 84/1.01 |

*Primary Examiner*—Robert K. Schaefer
*Assistant Examiner*—Vit W. Miska

[57] ABSTRACT

A pitch changing apparatus shifts the absolute pitch of musical output from an electronic organ. The apparatus combines two or more transposing switches in a cascade arrangement. In the preferred embodiment, the apparatus comprises four binary transposing switches in cascade relationship, with frequency divider circuits interposed between successive transposing switches. The preferred embodiment selects one out of twelve absolute pitches for the musical output in steps of one semitone. Other embodiments select absolute pitch in steps of two or three semitones. The other embodiments use arrays of electronic switching elements included in integrated circuit packages.

6 Claims, 14 Drawing Figures

FIG. 3
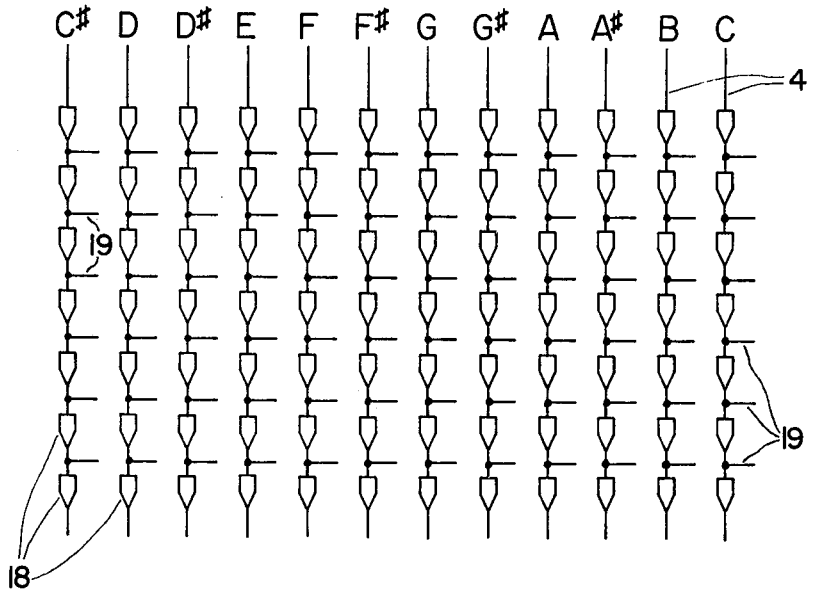
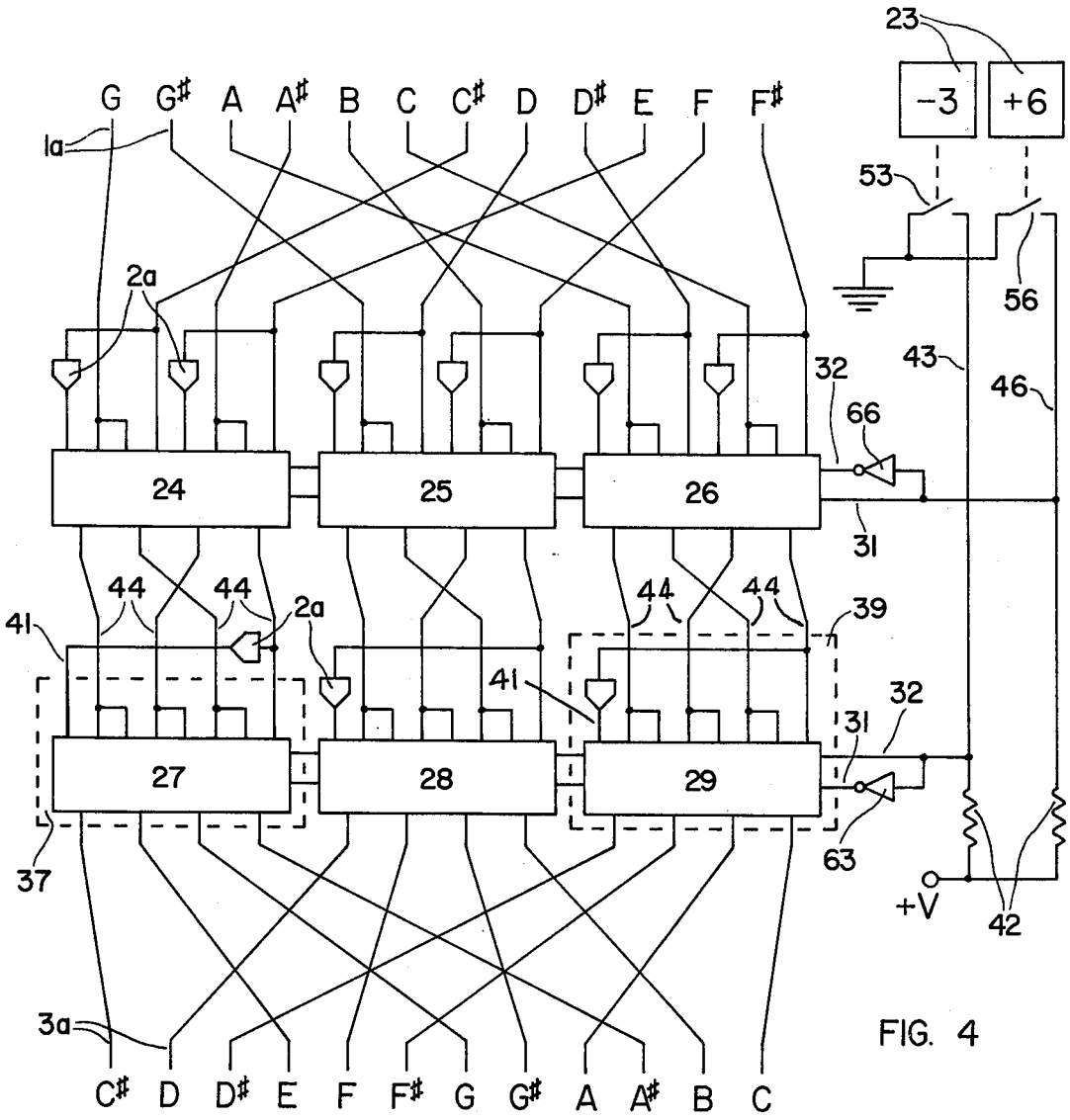
FIG. 4

| CHANGE IN SEMITONES | −4 | +4 | +2 | +1 | CHANGE IN SEMITONES | −4 | +4 | +2 | +1 |
|---|---|---|---|---|---|---|---|---|---|
| +1 | ⊔ | ⊔ | ⊔ | ⊔ | +7 | ⊔ | ⊔ | ⊔ | ⊔ |
| 0 | ⊔ | ⊔ | ⊔ | ⊔ | +6 | ⊔ | ⊔ | ⊔ | ⊔ |
| −1 | ⊔ | ⊔ | ⊔ | ⊔ | +5 | ⊔ | ⊔ | ⊔ | ⊔ |
| −2 | ⊔ | ⊔ | ⊔ | ⊔ | +4 | ⊔ | ⊔ | ⊔ | ⊔ |
| −3 | ⊔ | ⊔ | ⊔ | ⊔ | +3 | ⊔ | ⊔ | ⊔ | ⊔ |
| −4 | ⊔ | ⊔ | ⊔ | ⊔ | +2 | ⊔ | ⊔ | ⊔ | ⊔ |

| CHANGE IN SEMI-TONES | -3 | +6 |
|---|---|---|
| +6 | | |
| +3 | | |
| 0 | | |
| -3 | | |

| CHANGE IN SEMI-TONES | -2 | +2 | +1 | CHANGE IN TONES |
|---|---|---|---|---|
| | -4 | +4 | +2 | |
| +6 | | | | +3 |
| +4 | | | | +2 |
| +2 | | | | +1 |
| 0 | | | | 0 |
| -2 | | | | -1 |
| -4 | | | | -2 |

MUSICAL APPARATUS

BACKGROUND OF THE INVENTION

1. Field of the Invention

A tone transposing apparatus whereby each sound produced is systematically different in pitch from that normally associated with the digital struck.

2. Description of the Prior Art

With an organ tuned in the conventional equitempered scale, a musical composition may have all of its tones uniformly raised or lowered by a pitch changing mechanism; it will be recognized in that case as being the same composition, pitched higher or lower. Such a pitch changing mechanism is useful when a singer is accompanied by an organ or piano, for the singer often wishes the absolute pitch of the accompaniment to be changed higher or lower than the music is written. While transposition by an octave up or down is comparatively easy, such octave transpositions are usually of too large a magnitude. Experience has shown that an accompanist who can play by ear in four well separated keys can accommodate most musical compositions to a particular group of voices.

In order to accompany other musical instruments, it is desirable to be able to set a pitch changing apparatus to a standard position in which middle A has a fundamental frequency of 440 Hz. Since other musical instruments may be playing in different keys, the pitch changer should preferably be able to shift to other absolute pitches for the musical output which differ from standard absolute pitch by a integral number of semitones.

Transposition of written music can be accomplished, without changing the fingering of the music as written, by means of a pitch changing switch which alters the couplings between the tone generators and the digitals which actuate them. Such a switch changes all tones uniformly by a selected amount—for example, three semitones upward.

Bode, in U.S. Pat. No. 3,023,659, and Derry, in U.S. Pat. No. 3,674,907 have disclosed pitch changing apparatus in which the pitch of only the top octave of tone generators is switched; lower octaves of tones are derived from the top octave by twelve chains of frequency dividers. The Bode apparatus has a standard state and eleven transported states, allowing selection from a total of twelve different absolute pitches for the musical output. The apparatus has twenty-three audio input leads and twelve audio output leads.

Most musical instruments do not presently contain pitch changers, mainly because of their size and expense.

SUMMARY OF THE INVENTION

My pitch changing apparatus utilizes transposing switches in a cascade arrangement. A combination of four binary transposing switches allows selection of one out of twelve absolute pitches for the musical output, in steps of one semitone. In a second embodiment, a combination of two electronic transposing switches allows selection of one of four absolute pitches in steps of three semitones. A combination of three electronic transposing switches allows selection of one of six absolute pitches in steps in two semitones. In the preferred embodiment, frequency divider circuits are interposed between successive switches in the apparatus, so that each transposing switch need have only twelve audio output leads. Further economies are effected by combining cascaded electronic components in the same integrated circuit package.

BRIEF DESCRIPTION OF THE DRAWINGS

FIG. 3 shows twelve chains of frequency dividers.

FIG. 4 diagrams a second embodiment of my pitch changing apparatus.

DESCRIPTION OF THE PREFERRED EMBODIMENT

Figure 1:
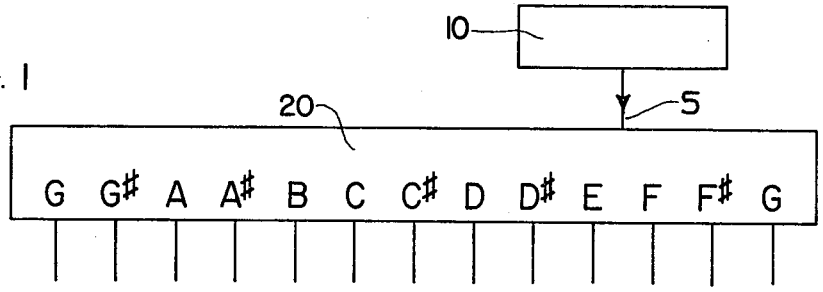
FIG. 1 diagrams apparatus for generating musical tones.

Tone generating apparatus for the top octave of my organ is shown in FIG. 1. Master oscillator 10 has a square wave output at a frequency of approximately 1.5 MHz, or a period equal to approximately two thirds of a microsecond. Octave tone generator 20 has its reference input lead 5 coupled to the master oscillator. The generator produces square wave outputs with periods equal to that of the master oscillator multiplied by the integers 478,451,426,402,379,358,338,319, 301,284,268,253 and 239. This period multiplication (or frequency division) produces thirteen audio frequency tone signals ranging from G at 3136 Hz up an octave to G at 6272 Hz. The sequence of tones constitutes an approximately equitempered scale.

In an ideal equitempered scale, the thirteen frequencies would be related to the lowest frequency as the Rth power of the twelfth root of two, where R is an integer running from zero to twelve. The musical intervals between consecutive tones, which I call the intertone intervals, would be exactly equal to each other, each intertone interval being equal to a semitone.

My octave generator produces a sequence of tones that is sufficiently close to the ideal equitempered scale that the normal ear each does not notice the difference. The ratio of each period to each of the other twelve periods is, within a fraction of a percent, the Pth power of the twelfth root of two, where P is an integer in the range one to twelve. Thus each tone is perceived as spaced from each of the other tones by an integral number of P semitones.

Figure 2:
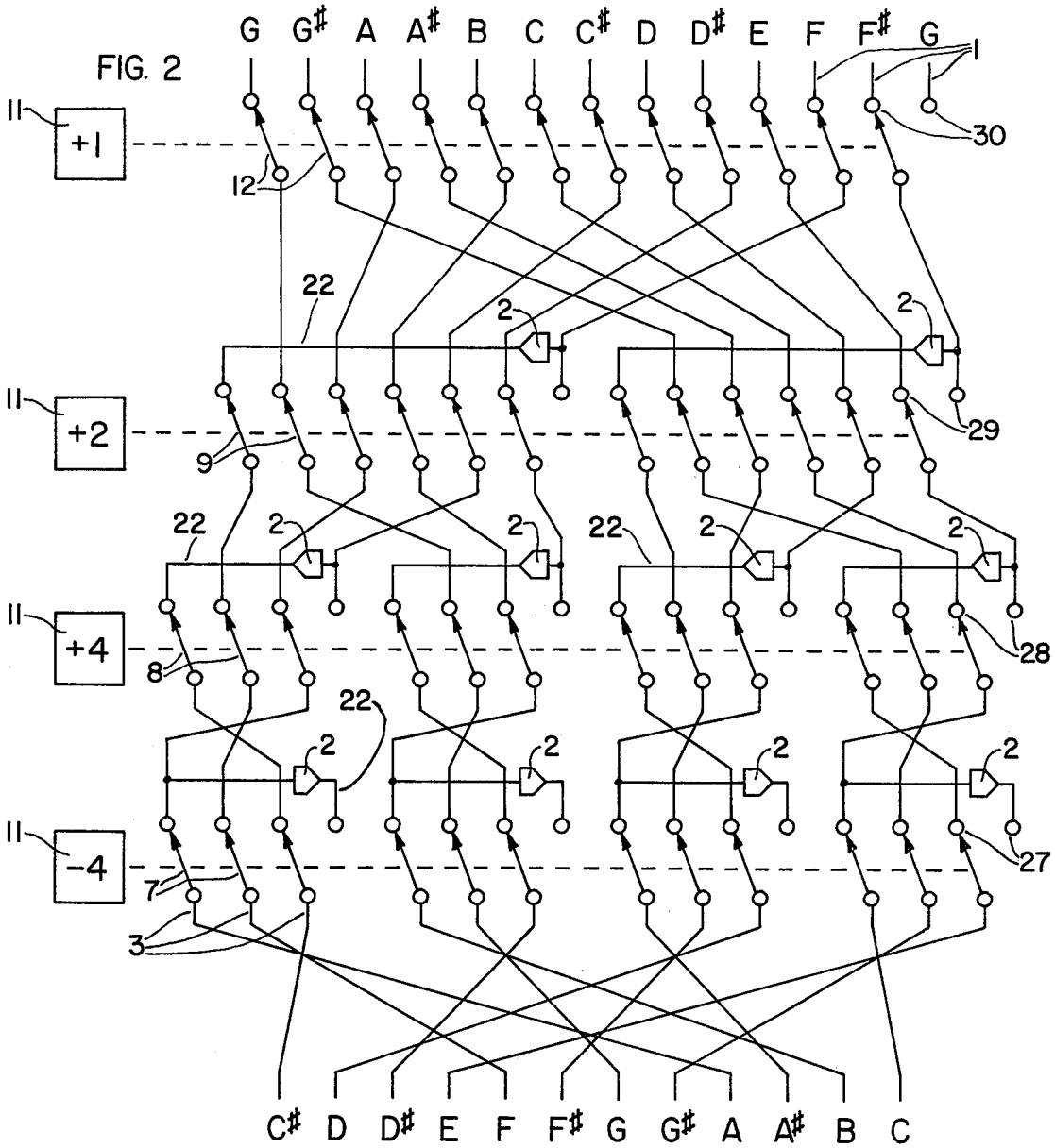
FIG. 2 diagrams my pitch changing apparatus.

My pitch changer apparatus contains four twelve-pole binary transposing switches in a cascade arrangement. A wiring diagram for the arrangement is shown in FIG. 2. Audio input leads 1 are identified by letters corresponding to the tones generated by the primary tone generator circuits, to which they are connected. The four sets of ganged moving contacts 7,8,9,12 are moved by means of four corresponding pushbuttons 11.

Normally, as shown in FIG. 2, the ganged moving contacts 7,8,9,12 are in contact with arrays of stationary contacts 27,28,29,30, so that each individual moving contact touches the stationary contact to its immediate left. When a pushbutton is depressed, its associated set of ganged moving contacts moves to the right so that each moving contact touches the stationary contact to its immediate right.

The pitch changer is shown in its standard state, in which no pushbuttons are depressed; audio output leads 3 are labeled to correspond to this standard state. In this state, output pitches range from C at 2217 Hz up to C at 4186 Hz. The audio output leads 3 are connected to twelve chains of frequency dividers circuits, as shown in FIG. 3.

Referring to FIG. 3, input leads 4 to the chains of dividers 18 are coupled to the pitch changer output leads. The twelve chains of dividers 18 are arranged from left to right in order of increasing pitch, with labels corresponding to tones received in the standard state of the pitch changing switch. Each chain contains seven divider circuits, the seven divider output leads 19 transmitting square waves with frequencies equal to the input frequency divided by 2,4,8,16,32,64,128. Thus succeeding output leads 19 in each chain transmit the input tone in descending octave relationship.

Referring again to FIG. 2, ten frequency dividers circuits 2 are located between the switches of my pitch changing apparatus, to provide lower tones for succeeding switches. Each divider 2 has a single electrical output lead 22 transmitting a tone one octave below its input tone. This positioning of dividers reduces the number of contact elements that are required in the early switches, allowing twelve-pole switches to be used in each stage.

When pushbutton labeled +1 is depressed, it latches down, activates the first transposing switch, and raises the output absolute pitch by one semitone.

When pushbutton labeled +2 is depressed, it latches down, activates the second transposing switch, and raises the output absolute pitch by two semitones.

When pushbutton labeled +4 is depressed, it latches down, activates the third transposing switch, and raises the output absolute pitch by four semitones.

When pushbutton labeled −4 is depressed, it latches down, activates the fourth transposing switch, and lowers the output absolute pitch by four semitones.

If two or more pushbuttons are simultaneously depressed, each of them latches down. If one or more pushbuttons are latched down and a new pushbutton is depressed, the previously latched pushbuttons will be released and the new pushbutton will latch down. Arrays of interlocking pushbuttons with these properties are well known. They are marketed by Oak Industries, Inc. and by Globe-Union, Inc.

When two or more pushbuttons are latched down, the effect on absolute pitch is the algebraic sum of the effects of the individual pushbuttons. Thus when the +1 and +2 pushbuttons are both depressed, the absolute pitch is raised three semitones above standard pitch. In general, if operation of a first switch alone raises the absolute pitch by T semitones, and operation of a second switch alone raises the absolute pitch by V semitones, then operation of both switches together will raise the absolute pitch by T + V semitones. If operation of a third switch alone will raise the absolute pitch by W semitones, then operation of all three switches together will raise the absolute pitch by T + V + W semitones. The integers T,V,W can be positive, negative, or zero. In the case of the set of moving contacts 7 in FIG. 2, depression of the pushbutton labeled −4 raises the pitch by −4 semitones. That is, it lowers the pitch by four semitones.

When the +1, +2 and +4 pushbuttons are all depressed, the pitch is raised seven semitones. In this switch state, a pitch which is normally C is raised to G, and a pitch which is normally D is raised to A. The pushbutton code corresponding to different changes of output pitch is shown in FIG. 5.

Figures 5, 6:
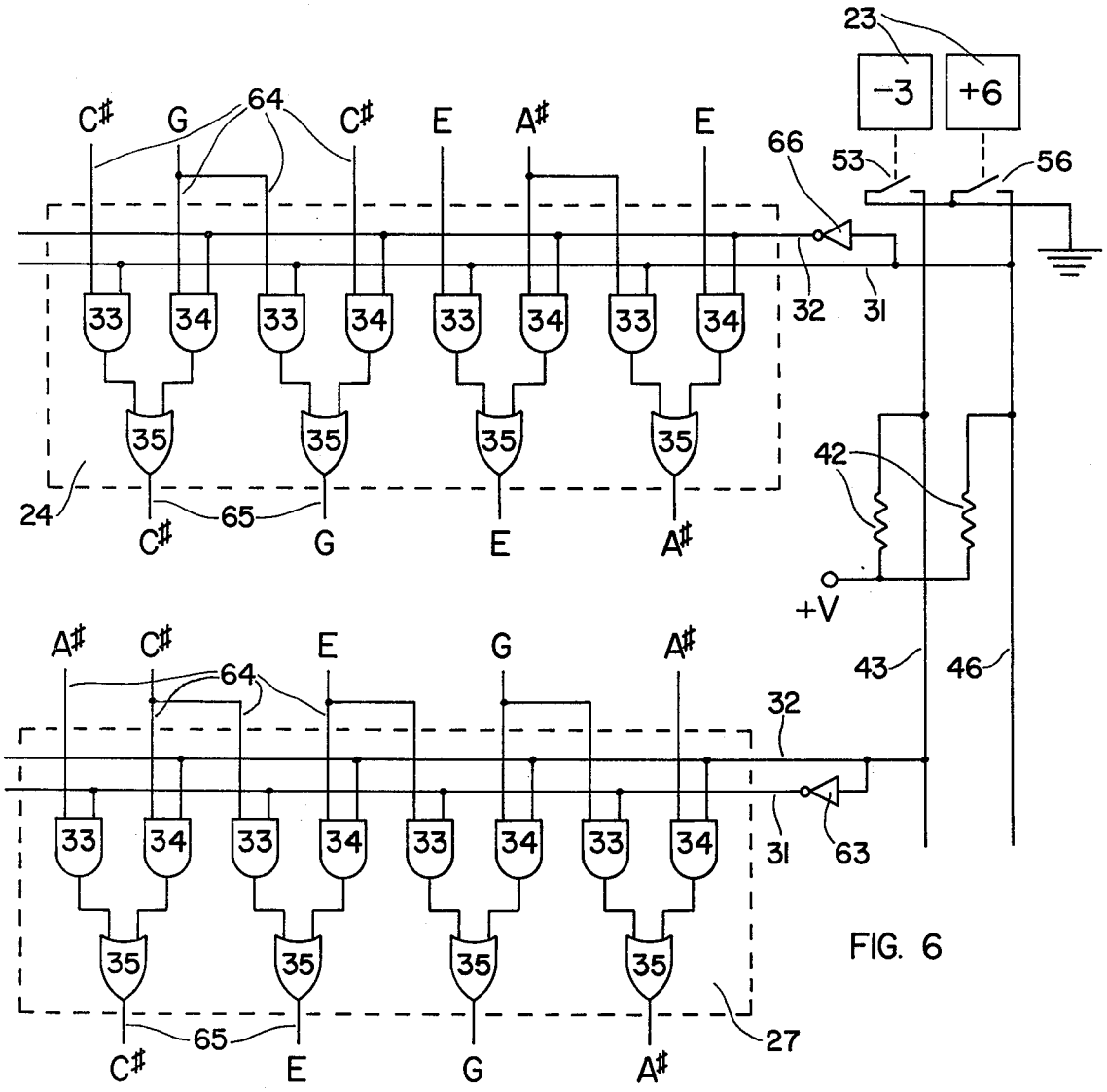
FIG. 5 tabulates the change of pitch for different arrangements of four pushbuttons.
FIG. 6 is a wiring diagram for the second embodiment.

FIG. 5 shows side views of the four pushbuttons in twelve different pushbutton arrangements. Columns 1 and 3 of FIG. 5 show, for each pushbutton arrangement, the absolute pitch change in semitones from the normal state. Thus the symbol +1 in column 1 corresponds to an increase of pitch by one semitone above standard pitch. The symbol −4 in column 1 corresponds to a decrease of pitch by four semitones below the normal state.

Output tones from the first transposing switch are shown in Table 1 for both the upper and lower pitch states of the switch. The heading of Table 1 gives the twelve output leads arranged and numbered in order of increasing pitch.

Table 1

| Switch State | 1 | 2 | 3 | 4 | 5 | 6 | 7 | 8 | 9 | 10 | 11 | 12 |
|---|---|---|---|---|---|---|---|---|---|---|---|---|
| Upper Pitch | G# | A | A# | B | C | C# | D | D# | E | F | F# | G |
| Lower Pitch | G | G# | A | A# | B | C | C# | D | D# | E | F | F# |

The second tranposing switch is conveniently divided into two sub-switches, each having its own frequency divider. Similarly, the third and fourth transposing switches are divided into four sub-switches, each with its own frequency divider. Output tones from the second, third and fourth transposing switches are shown in Table 2, with output pitches shown increasing to the right for each separate sub-switch in each switch state.

Table 2

| TRANSPOSING SWITCH | | OUTPUT TONES IN LOWER PITCH STATE 1 | 2 | 3 | 4 | 5 | 6 | OUTPUT TONES IN UPPER PITCH STATE 1 | 2 | 3 | 4 | 5 | 6 |
|---|---|---|---|---|---|---|---|---|---|---|---|---|---|
| 2 | 2a | F | G | A | B | C# | D# | G | A | B | C# | D# | F |
| | 2b | F# | G# | A# | C | D | E | G# | A# | C | D | E | F# |
| 3 | 3a | C# | F | A | | | | F | A | C# | | | |
| | 3b | D# | G | B | | | | G | B | D# | | | |
| | 3c | D | F# | A# | | | | F# | A# | D | | | |
| | 3d | E | G# | C | | | | G# | C | E | | | |
| 4 | 4a | A | C# | F | | | | C# | F | A | | | |
| | 4b | B | D# | G | | | | D# | G | B | | | |
| | 4c | A# | D | F# | | | | D | F# | A# | | | |
| | 4d | C | E | G# | | | | E | G# | C | | | |

In FIGS. 1,2,3, reference numbers represent commercial components as follows:

10 represents crystal oscillator L24R2, marketed by the Connor-Winfield Corporation;

20 represents tone generator MK50240, marketed by the Mostek Corporation;

2 represents flip-flop CD4013A, marketed by RCA;

18 represents counter CD4024A, marketed by RCA.

My four-stage pitch changing apparatus allows selection of one out of twelve absolute pitches in steps of a single semitone. The apparatus has only one third as many moving contacts as the previously mentioned pitch changing switch disclosed by Bode. That switch required one hundred and forty-four insulated moving contacts; my four-stage pitch changer with interposed frequency dividers requires only forty eight insulated moving contacts.

OTHER EMBODIMENTS

The arrays of mechanical switch elements shown in FIG. 2 may equally well be arrays of electronic switching elements. If electronic switches are used, however, care must be taken that the series of cascaded switches do not seriously degrade the signals. The frequency divider circuits require square wave signals with well defined upper and lower voltage levels. If diode transposing switches are used, they will tend to change these levels. Especially when several such switches are used in a cascade arrangement, the signals may become so seriously attenuated that they canot operate the twelve chains of frequency divider circuits. Additionally, when many parallel signal channels are operated in cascade, signal leakage and crosstalk between channels can develop into a serious degradation of the individual signals.

I avoid such signal degradation in my electronic switches by using switch elements of a binary digital nature that have latent current and power gain. The latent power gain prevents any attenuation that would result from the use of inactive switching elements. In the second embodiment of my invention, integrity of the tone signals is ensured by the use of switching elements with a voltage output very close to the voltage input, and with a latent current gain greater than unity. Four such switch elements can be obtained in a single standard integrated circuit package. Thus the forty eight switch elements shown in FIG. 2 will require twelve standard integrated circuit packages — three for each twelve-pole transposing switch. If only two transposing are used, then only six integrated circuit packages are needed.

Referring to FIG. 4, pushbuttons 23 are used to control two cascaded electronic transposing switches. The pushbuttons are single-pole, single-throw, with latching properties like those in the preferred embodiment. In this second embodiment, switching modules 24-29 are the commercially available integrated circuit packages. The three modules 24,25,26, which are controlled by the pushbutton labeled +6, constitute a first tranposing switch. The three modules 27,28,29, which are controlled by the pushbutton labeled −3, constitute a second transposing switch. These first and second tranposing switches are operated in a cascade arrangement. As in the preferred embodiment, the absolute pitch change produced by the two switches together is the sum of absolute pitch changes produced by the individual switches.

Referring to FIG. 4, leads 43 and 46 are normally held at a positive potential (which may be 15 volts) by means of pull-up resistors 42. Lead 46 controls modules 24,25,26, while lead 43 controls modules 27,28,29. When the pushbutton labeled +6 is depressed, pushbutton switch 56 grounds lead 46, thereby causing modules 24,25,26 to raise the pitch by six semitones. When the pushbutton labeled −3 is depressed, pushbutton switch 53 grounds lead 43, thereby causing modules 27,28,29 to lower the pitch by three semitones.

Figures 7, 8, 9:
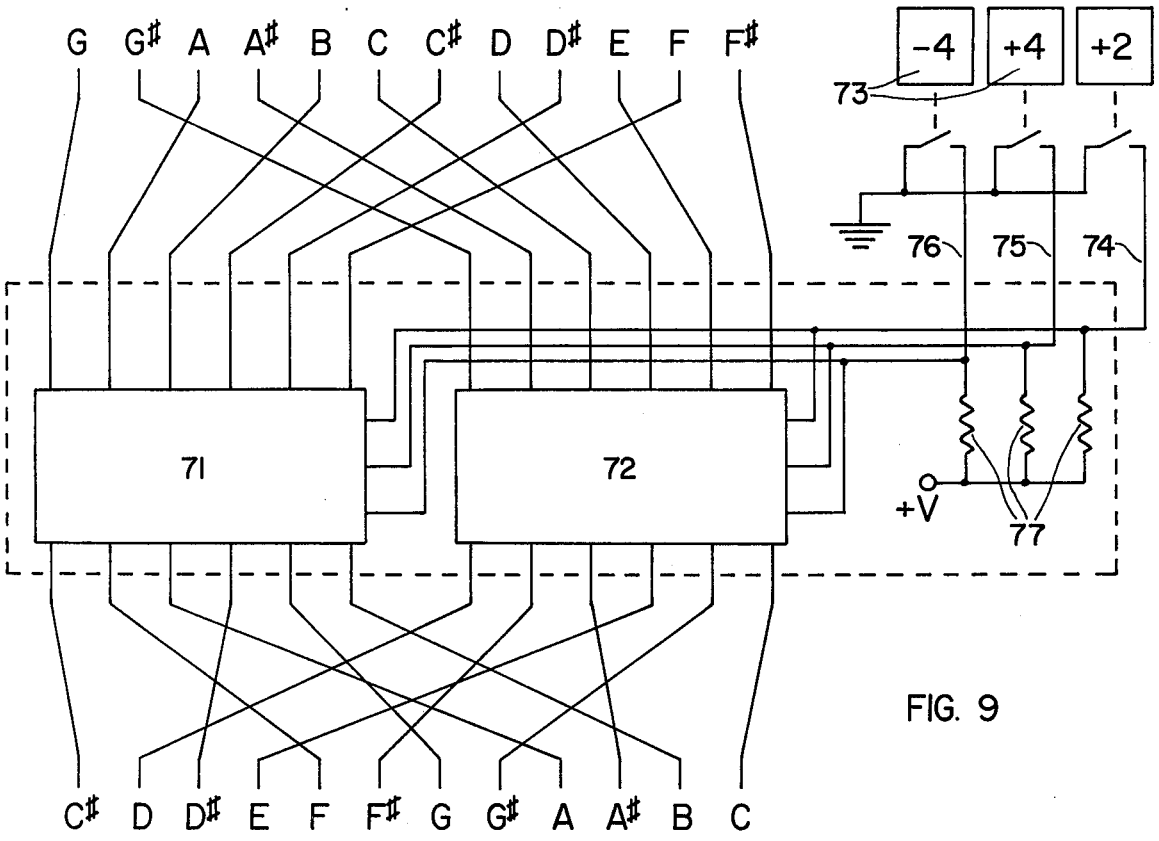
FIG. 7 tabulates pitch changes for different arrangements of two pushbuttons.
FIG. 8 tabulates pitch changes for different arrangements of three pushbuttons.
FIG. 9 diagrams a third embodiment.

Different arrangements of the two pushbuttons produce a selection of four different absolute pitches separated by three semitones, as indicated in FIG. 7. This figure shows side views of the two pushbuttons in four different arrangements. Column 1 shows, for each pushbutton arrangement, the pitch change from the normal state in semitones.

Referring again to FIG. 4, the switch apparatus has twelve audio output leads 3*a* and only twelve audio input leads 1*a*. In order to provide the extra tones needed for pitch selection, nine of the available tones must be operated on by frequency dividers to provide nine lower tones. Thus, for module 24, the two received tones C♯,E are operated on by frequency dividers 2*a* to produce C♯,E tones an octave lower.

The six integrated circuit packages 24–29 are identical to each other. Each package contains four AND-OR gates. The gates belong to a family of complementary metal-oxide-semiconductor devices, which have large latent current and power amplification. With one audio input enabled and a ten kilohm load, the signal current and power output from a gate is much greater than the signal current and power input used to produce the output. The signal current and power output is mostly drawn from the amplifier power supply. Each gate has a voltage gain greater than ten, for a small signal centered midway between the power supply potential V and ground potential. When the input leads are held at the power supply potential V, the output potential is very close to V. When the input is held at ground potential, the output potential is very close to ground potential.

Each gate has an input resistance of the order of $10^{12}$ ohms in parallel with an input capacitance of approximately 5 pf. The output impedance of each device is much lower than the input impedance. Because of the high input resistance, the D.C. input current is typically 10 picoampheres, while the available output current is more than a million times higher. The latent audio current amplification and latent audio power gain allow many devices to be operated in cascade without degradation of the signal. Details of typical integrated circuit packages 24 and 27 are shown in FIG. 6.

Referring to package 24 or 27 in FIG. 6, each of the four AND-OR gates comprises a left AND gate 33, a right AND gate 34, and an output OR gate 35. The OR gate collects an output signal from one of the two AND gates and transmits it on output lead 65.

Each AND gate receives a tone signal input through input lead 64. These input leads are labeled according to the tones they receive from the top octave generator, with the pitch to the right AND gate always higher than the pitch to the left AND gate. All four left AND gates 33 are influenced by the lower control rail 31. All four right AND gates 34 are influenced by the upper control rail 32. Thus the lower control rail influences the lower of two tones, the upper control rail influences the higher of the two tones.

In module 24 specifically, lower control rail 31 is connected directly to control lead 46, while upper control rail 32 is connected to control lead 46 via inverter 66. With these connections to the control lead, the Boolean algebraic equation and truth table for each AND-OR gate are:

$$X = C.L + \overline{C}.R$$

| C | X |
|---|---|
| 1 | L |
| O | R |

where 1 represents the power supply potential +V, 0 represents ground potential, X represents the square wave potential on output lead 65, L represents the square wave potential received by the left AND gate from the tone generators, R represents the square wave potential received by the right AND gate from the tone generators, C represents the steady potential on control lead 46, $\overline{C}$ represents the negation of C.

These relations apply to all twelve AND-OR gates guided by control lead 46, which twelve gates constitute the first transposing switch.

In each AND-OR gate, the left AND gate of the combination receives an audio signal which is six semitones below that received by the right AND gate of the combination. Since the normally positive control lead 46 enables the left AND gates and disables the right AND gates, the switch is normally in the low pitch state. Depression of the +6 pushbutton, which grounds control lead 46, will disable the left AND gates and enable the right AND gates instead, thus raising the absolute pitch uniformly by six semitones.

Referring back to FIG. 4, the second transposing switch, comprising modules 27,28,29, is controlled by the pushbutton labeled −3. Depression of this pushbutton closes pushbutton switch 53 and grounds control lead 43. In this switch, the inverter 63 is placed in the lower control rail rather than the upper control rail, with the result that this switch is normally in the upper pitch state. Consequently, depression of the pushbutton will lower the absolute pitch.

Referring again to FIG. 6, the integrated circuit package 27, typical of the second transposing switch, has its upper control rail 32 connected directly to control lead 43, while its lower control rail 31 is connected to control lead 43 via inverter 63. With these reversed connections to control lead 43, the equation and truth table for each AND-OR gate are:

| | D | Y |
|---|---|---|
| $Y = \overline{D}.L + D.R$ | 1 | R |
| | O | L |

where:

Y represents the square wave potential on output lead 65,

L represents the square wave potential received by the left AND gate from the tone generators, R represents the square wave potential received by the right AND gate from the tone generators, D represents the steady potential on control lead 43, $\overline{D}$ represents the negation of D.

These relations apply to all twelve AND-OR gates guided by control lead 43, which twelve gates constitute the second transposing switch. In each AND-OR gate, the left AND gate in each AND-OR combination receives an audio signal which is three semitones below that received by the right AND gate in the combination. Thus depression of the −3 pushbutton will lower the absolute pitch uniformly by three semitones.

Each of the two transposing switches shown in FIG. 4 may be divided into sub-switches which are associated with separate frequency divider circuits. The output tones from the nine sub-switches are shown in Table 3. The heading of Table 3 shows the output leads for each sub-switch arranged and numbered in order of increasing pitch.

Table 3

| TRANSPOSING SWITCH | | OUTPUT TONES (LOWER STATE) 1 | 2 | 3 | 4 | OUTPUT TONES (UPPER STATE) 1 | 2 | 3 | 4 |
|---|---|---|---|---|---|---|---|---|---|
| 1 | 24a | C# | G | | | G | C# | | |
| | 24b | E | A# | | | A# | E | | |
| | 25a | D | G# | | | G# | D | | |
| | 25b | F | B | | | B | F | | |
| | 26a | D# | A | | | A | D# | | |
| | 26b | F# | C | | | C | F# | | |
| 2 | 27 | C# | E | G | A# | E | G | A# | C# |
| | 28 | D | F | G# | B | F | G# | B | D |
| | 29 | D# | F# | A | C | F# | A | C | D# |

In FIGS. 4 and 6, reference numbers represent commercial components as follows:

24-29 represent AND-OR gates CD 4019 A,

63,66 represent inverters CD 4009 A,

2a represent flip-flop CD 4027 A,

42 represents 10 kilohm resistors.

The electronic components are marketed by RCA.

The above electronic components all belong to the family of complementary metal-oxide-semiconductors devices; they are compatible with the previously described tone generator circuits and the twelve chains of frequency divider circuits. All devices can operate from the same power supply, with a supply voltage in the range 10 to 15 volts.

In transposing switches of this type, the number of terminal connector pins can be greatly reduced by using specially designed integrated circuits. As an example, the package 27 in FIG. 6, which requires sixteen pins, could be reduced to a thirteen pin package by making internal connections between the signal input leads of adjacent AND-OR gates. Each pair of adjacent AND-OR gates would then share a common external signal input pin connector.

An integrated circuit package of this general type would contain S signal input leads and S-1 signal output leads. If the input leads are labeled by an ordinal number M running from one to S, and the output leads are labeled by an ordinal number N running from two to S, then, in the upper pitch state, each output lead labeled N would be coupled to the package input lead labeled $M = N$. In the lower pitch state, each output lead labeled N would be coupled to the switch input lead labeled $M = N - 1$.

The special package for the case $S = 5$ is indicated by the dotted rectangle 37 in FIG. 4, where the four input leads 44 come from module 24 and input lead 41 comes from frequency divider 2a. If inverter 63 is included within each package, then this package, with five signal input leads, would require a total of twelve connector pins. Similarly, a six pole package with seven signal input leads would require a total of sixteen connector pins.

By including also the frequency divider 2a of FIG. 4 within such a special integrated circuit, the number of input leads may be further reduced or the switching capability increased (for a fixed number of input leads). Thus for a combination integrated circuit with S signal input leads, the number of signal output leads may be increased from S−1 to S, the output leads being now numbered from one to S.

In the higher absolute pitch state, the lowest pitch output lead, labeled $N = 1$, would be coupled to the lowest pitch input lead, labeled $M = 1$. In the lower absolute pitch state, the output lead labeled $N = 1$ would be connected to the lead 41 from the frequency divider (the input lead of the frequency divider being connected to the highest pitch switch input lead labeled $M = S$). This combination package for the special case $S = 4$ is illustrated by the dotted rectangle 39 in FIG. 4.

A still greater reduction in the number of connector pins is achieved by combining at least two cascaded transposing switches in the same special integrated circuit. Such a combination eliminates all signal output connector pins from the first transposing switch and all signal input connector pins for the second transposing switch. These economies are effected in a third embodiment of my invention, shown in FIG. 9, which provides a selection of six absolute pitches separated from each other by two semitones.

Referring to FIG. 9, only two identical integrated circuit packages 71,72 are needed. These are controlled by three pushbuttons 73. The pushbuttons are single-pole, single-throw, with latching properties like those in the preferred embodiment. In the normal state of the switching apparatus, control leads 74,75,76 are held at a positive potential (which may be 15 volts) by means of three pull-up resistors 77. When the pushbuttons labeled +2, +4, −4 are depressed, they ground leads 74,75,76, and produce pitch changes by +2, +4, −4 semitones respectively.

As in the preferred embodiment, the pitch change produced by two or three pushbuttons together is the sum of the pitch changes produced by the individual switches. The arithmetic needed to compute the total pitch change is somewhat easier if pitch changes are measured in units of two semitones, this unit being called a tone. Both semitones and tones are used in the tabulation of pitch changes, shown in FIG. 8.

FIG. 8 shows side views of the three pushbuttons in six different arrangements. Column 1 shows, for each pushbutton arrangement, the absolute pitch change from the normal state in semitones. Column 3 shows the same pitch change in tones. The heading of column 2 gives the pitch changes for individual switches in either tones or semitones. A circuit diagram for one of the integrated circuit packages is shown in FIG. 10.

Figure 10:
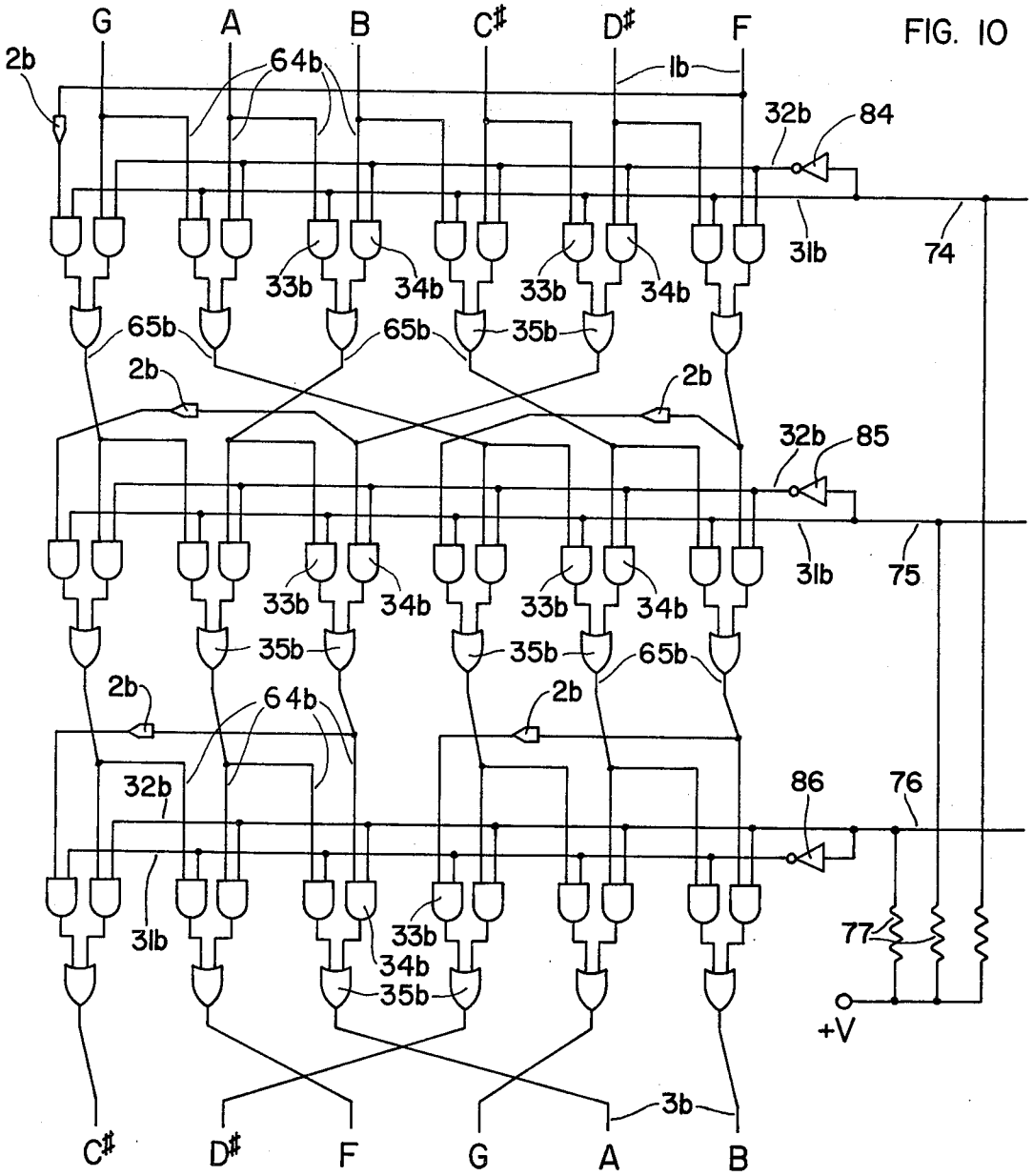
FIG. 10 is a wiring diagram for the third embodiment.

Referring to FIG. 10, the third embodiment, like the second embodiment, used arrays of side-by-side AND-OR gates for each transposing switch. In each AND-OR gate, the left AND gate **33*b* and right AND gate 34*b* receive audio signals through input leads 64*b*. The OR gate 35*b* collects the audio signal from one of the two AND gates and transmits this signal on output lead 65*b*. In all transposing switches, the left AND gate, with the lower pitch input, is influenced by lower control rail 31*b*; the right AND gate, with the higher pitch input, is influenced by upper control rail 32*b*.** Consequently, the lower control rail activates the lower of the two input tones, the upper control rail activates the upper of the two input tones.

We refer now to the first transposing switch in FIG. 10, which is guided by control lead 74. This lead is connected directly to lower control rail **31*b* and via inverter 84 to upper control rail 32*b*.** Since the lower control rail is normally held positive by the pull-up resistors, the left AND gates are enabled, and the switch is normally in the lower pitch state.

The lowest pitched input tone F is derived from the highest pitched input tone F (corresponding to $M = S$) by means of frequency divider **2*b*. As shown by the tone labels for this first transposing switch, the tone received by each right AND gate is two semitones higher than that received by the left AND gate in the same group. Thus, depression of the pushbutton labeled +2 in FIG. 9, which grounds control lead 74,** will enable the right AND gates and raise the absolute pitch of the musical output by two semitones.

The second transposing switch is guided by control lead 75 in the same way. In this case also, control lead 75 is connected directly to lower control rail **31*b*, and via inverter 85 to upper control rail 32*b*. Two frequency dividers 2*b* are necessary to provide a sufficient number of input tones for this switch. Since input tones to the same AND-OR gate are separated by four semitones, grounding of control lead 75** will raise the absolute pitch by four semitones.

The third transposing switch is guided by control lead 76. Connections to the control rails are reversed for this switch; lead 76 is connected directly to upper control rail **32*b* and via inverter 86 to lower control rail 31*b*. This reversal of connections has the result that grounding of control lead 76,** will lower the absolute pitch by four semitones, rather than raising it.

The second and third transposing switches shown in FIG. 10 may each be divided into two sub-switches associated with separate frequency divider circuits. Thus the whole pitch changing apparatus, shown in FIG. 9, contains ten sub-switches, each with its own frequency divider circuit. Output pitches for the ten sub-switches, arranged in order of increasing pitch for each switch state, are the same as shown in Table 2 for the preferred embodiment.

This special monolithic integrated circuit uses the complementary metal-oxide-semiconductor technology, which is well known in medium an large scale integrated circuits. All frequency divider circuits **2*b* and inverters 84,85,86** are included in the same monolithic integrated circuit with the gates. The integrated circuit package requires seventeen leads, including two power leads. It operates from a power supply with ten to fifteen volts D.C. output. The complete six-state pitch changer apparatus requires only two of these integrated circuits.

Experience shows that four-state pitch changers and six-state pitch changers are helpful in accommodating music to particular human voices. A more versatile twelve-state pitch changer can be made by combining my six-state pitch changer with a two-state pitch changer. A suitable two-state pitch changer is diagramed in FIG. 12. To reduce the number of connector pins needed, this switch may be incorporated into a special integrated circuit with an octave tone generator, as indicated in FIG. 11.

Figure 11:
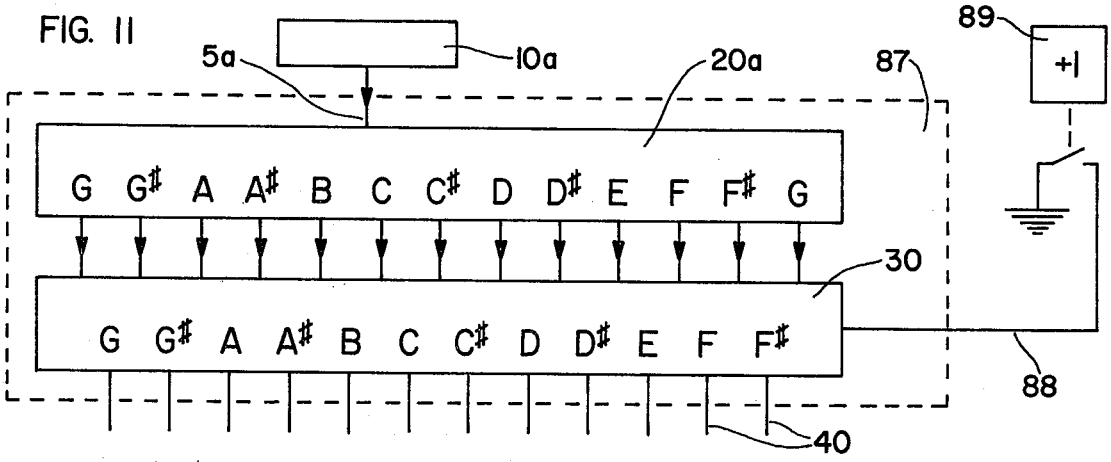
FIG. 11 diagrams a fourth embodiment.

Referring to FIG. 11, the monolithic integrated circuit 87 includes octave tone generator **20*a* coupled to two-state pitch changer 30. The octave generator is similar to that described and in the preferred embodiment; it feeds thirteen square wave tone signals to the pitch changer switch 30. Since only twelve audio outputs from the package are needed, the lead which is used in the commercial generator package for a thirteenth tone output can be used here for a pitch control lead 88. Thus the combination package requires only sixteen external leads — the same as the MK240** tone generator package alone. This arrangement eliminates the twenty-seven connector pins that would be needed for a separate two-state pitch changer.

Referring still to FIG. 11, the combination package 87 receives a 1.499 MHz reference signal on reference lead 5*a* from master oscillator 10*a*. Pushbutton 89 is used to ground the control lead 88 and thereby raise absolute pitch at output leads 40 by one semitone. The combination of this two-state pitch changer with the six-state pitch changer of the third embodiment is equivalent to the twelve-state pitch changer of the preferred embodiment, shown in FIG. 2. The four pushbuttons may be combined in a single array, and they will then select one out of twelve absolute pitches, as tabulated in FIG. 5. The two-state pitch changer 30 of FIG. 11 is detailed in FIG. 12.

Figure 12:
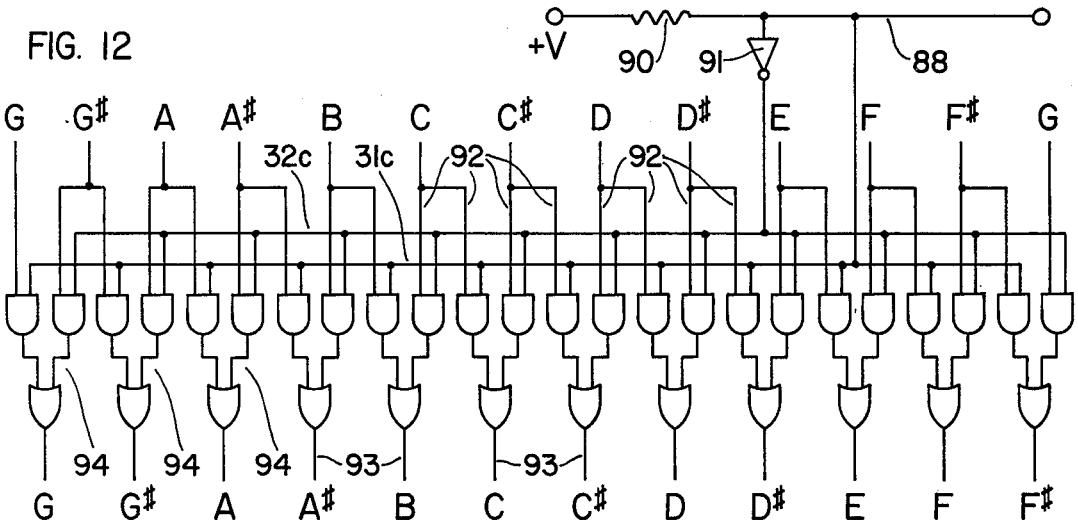
FIG. 12 is a wiring diagram for the fourth embodiment.

Referring to FIG. 12, the pitch changer switch consists of twelve AND-OR gates 94 in side-by-side arrangement. Each AND-OR gate receives, on its audio input leads 92, two square wave tone signals differing in pitch by a single semitone, with higher pitches being to the right. One of these two tone signals is selected and transmitted on each audio output lead 93.

Control lead 88 is normally held at a positive potential (such as a 15 volts) by pull-up resistor 90, which may be ten kilohms. This control lead 88 is connected directly to lower control rail 31*c* and via inverter 91 to upper control rail 32*c*. Since the control connections are the same as those for the first transposing switch in FIG. 10, the switch is normally in its low pitch state. Grounding of control lead 88 will produce an increase of pitch by one semitone at the audio output leads, as indicated in Table 1.

The integrated circuit package 87 of FIG. 11 is manufactured with well known complementary metal-oxide-semiconductor technology. The complete tone formation apparatus, including the octave tone generator and the twelve-state pitch changer, requires one integrated circuit package with sixteen leads plus two packages with seventeen leads each — a total of 50 leads.

Figure 13:
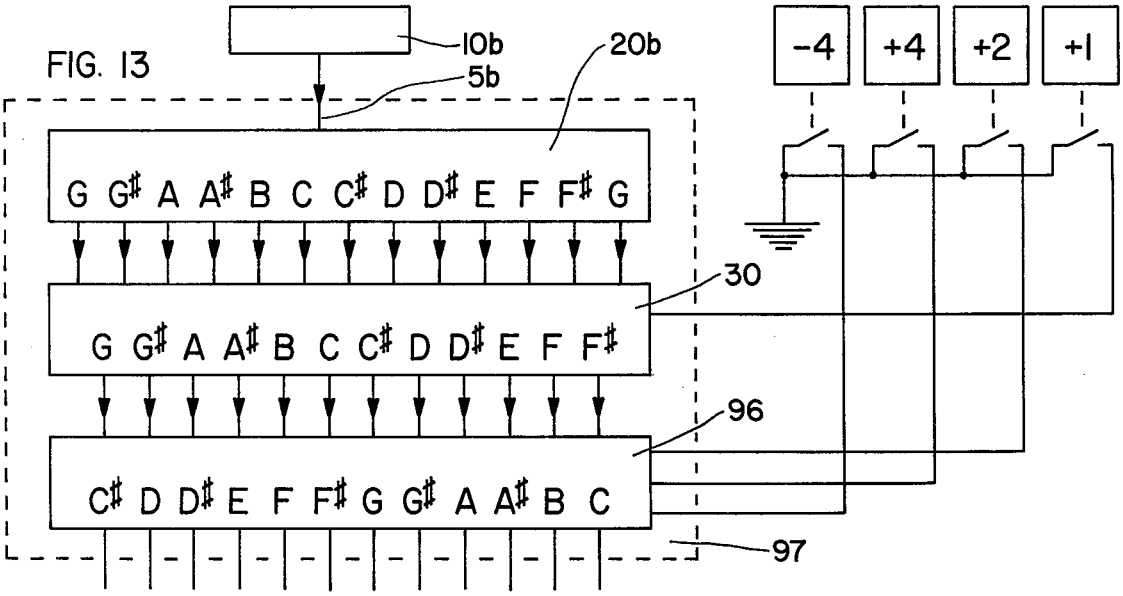
FIG. 13 diagrams a fifth embodiment.

The total of fifty leads for this tone formation apparatus can be reduced to nineteen external leads by combining an octave tone generator with the twelve-state pitch changer in a single integrated circuit package, as indicated in FIG. 13.

Referring to FIG. 13, two-state pitch changer 30 combines with six-state pitch changer 96 to make a twelve-state pitch changer, and this combines with octave generator 20*b* to make up the integrated circuit package 97. This tone formation apparatus for generating and transposing musical tones requires nineteen external leads, including two power leads. In addition, a master oscillator is needed.

Referring still to FIG. 13, the integrated circuit package 97 receives its reference high frequency signal through reference lead 5*b* from master oscillator 10*b*. The octave generator 20*b* is similar to that described in the preferred embodiment. Pitch changer 30 is as shown in FIG. 12. Pitch changer 96 is as shown in FIG. 10. Complementary metal-oxide-semiconductor technology is used for all of the components.

The integrated circuit package of FIG. 13, which requires nineteen pins, can be reduced to an eighteen pin package if the master oscillator 10*b* is included in the package. Thus a complete tone formation apparatus for generating and and transposing musical tones can be contained in a single integrated circuit package with eighteen pins. This package includes master oscillator, octave tone generator, and twelve-state pitch changer, as indicated in FIG. 14.

Figure 14:
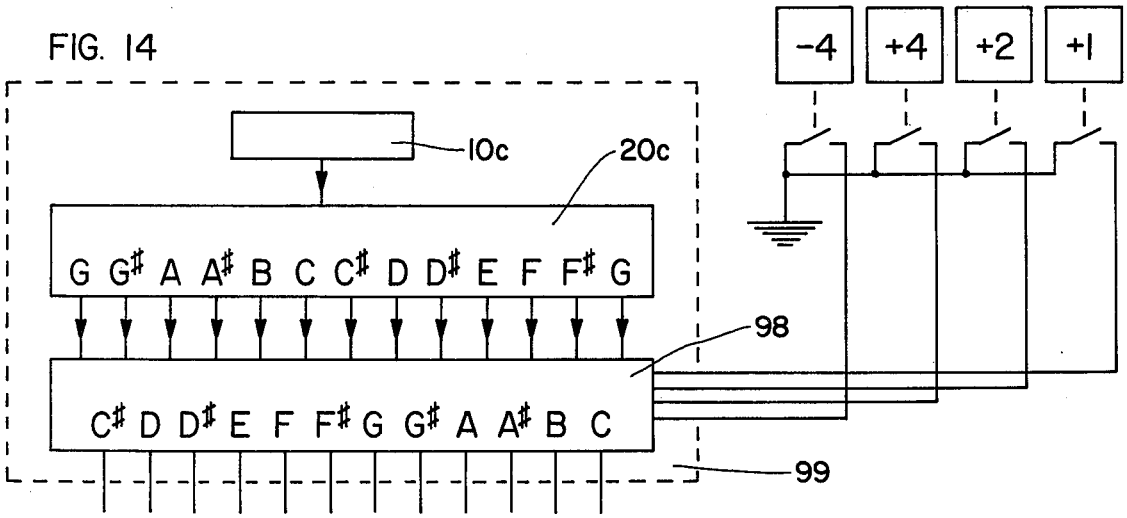
FIG. 14 diagrams a sixth embodiment.

Referring to FIG. 14, master oscillator 10*c*, octave tone generator 20*c*, and twelve-state pitch changer 98 are included in the single integrated circuit package 99. This construction not only reduces the number of external leads required for the tone formation apparatus from nineteen to eighteen; it also eliminates the separate master oscillator package with its output and power leads.

The octave tone generator and the absolute pitch changer need not be completely separate devices, as indicated in FIGS. 13 and 14. Without departing from the spirit of the invention, the operations of tone generation and tone transposition may be closely integrated, with a single monolithic integrated circuit containing at least part of the master oscillator, the many frequency divider circuits of the octave tone generator, the output gates, and circuitry for controlling the absolute pitch of the musical output. Circuit arrangements within the integrated circuit are not described in detail. Such detail is not necessary to an understanding of the invention and would unnecessarily complicate and enlarge the disclosure.

I claim:

1. In a muscial instrument, improved apparatus for changing absolute pitch of the musical output, the apparatus having:

at least thirteen circuits generating individual electrical tone signals fluctuating at audio frequencies, said tone generator circuits arranged in a single sequence proceeding from low frequency to high frequency with intertone musical intervals of a single semitone between consecutive members of the sequence; and first switching means having a first set of at least thirteen input leads and a first set of at least twelve output leads, the individual input leads receiving fluctuating electrical signals from said individual tone generator circuits, the number of switch input leads being greater than the number of switch output leads.

said first switching means having at least first and second switch states corresponding to different absolute pitches at the output leads, the absolute pitches of all tone signals at the first set of output leads being uniformly T semitones higher in the second switch state than in the first switch state, where T is an integer;

the improvement comprising;

second switching means having a second set of at least twelve input leads and a second set of at least eight output leads, the number of switch input leads being greater than the number of switch output leads, individual members of the second set of input leads receiving individual fluctuating electrical signals from individual members of the first set of output leads, said second switching means having at least first and second switch states corresponding to different absolute pitches at the second set of output leads, the absolute pitches of all tone signals at the second set of output lead being uniformly V semitones higher in the second switch state than in the first switch state, where V is an integer;

the absolute pitches of all tone signals at the second set of output leads being uniformly T + V semitones higher when said first and second switching means are both in their second switch states than when said first and second switching means are both in their first switch states.

2. Apparatus as recited in claim 1 further comprising at least one frequency divider circuit receiving a periodic fluctuating electrical tone signal from an output lead of said first switching means and transmitting a periodic electrical tone signal fluctuating at a reduced fundamental frequency to an input lead of said second switching means.

3. Apparatus as recited in claim 1 wherein said first and second switching means are included in a single monolithic integrated circuit.

4. Apparatus as recited in claim 1 further comprising third switching means having a third set of at least eight input leads and a third set of at least seven output leads, individual members of the third set of input leads receiving individual fluctuating electrical signals from the individual members of the second set of output leads;

said third switching means having at least first and second switch states corresponding to different absolute pitches at the third set of output leads, the absolute pitches of all tone signals at the third set of output leads being uniformly W semitones higher in the second switch state than in the first switch state, where W is an integer;

the absolute pitches of all tone signals at the third set of output leads being uniformly T + V + W semitones higher when said first, second and third switching means are all in their second switch states than when they are all in their first switch states.

5. Apparatus as recited in claim 1 wherein said integer V is included in the range one to four inclusive.

6. Apparatus as recited in claim 5 wherein said integer T is included in the range one to four inclusive.

* * * * *